US007624593B2

(12) United States Patent
Lee et al.

(10) Patent No.: US 7,624,593 B2
(45) Date of Patent: Dec. 1, 2009

(54) VEGETABLE ROOM FOR REFRIGERATOR

(75) Inventors: Sang-Ik Lee, Chungcheongbuk-Do (KR); Eun-Jeong Kim, Gyeongsangnam-Do (KR); Yeon-Yi Hwang, Busan (KR)

(73) Assignee: LG Electronics Inc., Seoul (KR)

( * ) Notice: Subject to any disclaimer, the term of this patent is extended or adjusted under 35 U.S.C. 154(b) by 707 days.

(21) Appl. No.: 10/531,978

(22) PCT Filed: Dec. 30, 2002

(86) PCT No.: PCT/KR02/02494

§ 371 (c)(1),
(2), (4) Date: Apr. 20, 2005

(87) PCT Pub. No.: WO2004/038312

PCT Pub. Date: May 6, 2004

(65) Prior Publication Data

US 2006/0005567 A1 Jan. 12, 2006

(30) Foreign Application Priority Data

Oct. 23, 2002 (KR) ..... 10-2002-0064973

(51) Int. Cl.
*F25D 17/04* (2006.01)

(52) U.S. Cl. ..... 62/408; 62/441

(58) Field of Classification Search ..... 62/408, 62/407, 441, 419, 261, 186, 302, 382; 220/592.1, 220/592.23, 371, 372, 373; 312/8.11, 8.2–8.6, 312/9.3, 236, 349, 350
See application file for complete search history.

(56) References Cited

U.S. PATENT DOCUMENTS

| | | | | |
|---|---|---|---|---|
| 2,267,486 | A | 12/1941 | West | 62/89 |
| 4,013,434 | A * | 3/1977 | Kronenberger et al. | 62/382 |
| 5,918,480 | A * | 7/1999 | Nagata et al. | 62/440 |
| 6,070,419 | A * | 6/2000 | Chang | 62/89 |
| 6,367,276 | B1 * | 4/2002 | Kim et al. | 62/288 |

FOREIGN PATENT DOCUMENTS

| | | |
|---|---|---|
| GB | 2079424 | 1/1982 |
| JP | 2150682 | 6/1990 |
| JP | 11083300 | 3/1999 |

* cited by examiner

*Primary Examiner*—Mohammad M Ali
(74) *Attorney, Agent, or Firm*—Ked & Associates LLP

(57) ABSTRACT

A vegetable room for a refrigerator is provided. The vegetable room includes a vegetable box disposed inside a refrigerator in which a cooling air supply unit is provided to circulate cooling air therein and a plurality of shelves is provided, and having a receptacle space that receives food items therein opened upwardly, a box cover that covers an opening side of the vegetable box to close the receptacle space of the vegetable box and having a plurality of cooling air ventilating holes formed at one side thereof to introduce cooling air into the vegetable box, a cover support unit interposed between the box cover and the shelf to support the box cover at the shelf, a plurality of opening and closing members that open and close the cooling air ventilating holes of the box cover, and an operating unit that operates the opening and closing members simultaneously.

23 Claims, 10 Drawing Sheets

VEGETABLE ROOM FOR REFRIGERATOR

TECHNICAL FIELD

The present invention relates to a vegetable room for a refrigerator and, more particularly, to a vegetable room for a refrigerator that is capable of keeping storage stuff fresh for a long period regardless of environmental conditions outside a refrigerator

BACKGROUND ART

In general, a refrigerator includes a freezing chamber for preserving freezing food items, a refrigerating chamber for keeping refrigerating food items, and a refrigerating cycle for supplying cooling air to the freezing chamber and the refrigerating chamber. A vegetable room is provided at a lower side of the refrigerating chamber to generally keep fruits, vegetables or functional storage items.

FIG. 1 is a vertical-sectional view showing one example of a refrigerator in accordance with a conventional art.

The conventional refrigerator includes: a main body 100 having a receptacle space therein, a freezing chamber 103 disposed at an upper portion of the main body 100 and keeping freezing items, a refrigerating chamber 109 disposed at a lower portion of the main body 100 by being partitioned from the freezing chamber 103 by a wall 105 and having a plurality of shelves 107 for receiving refrigerating food items, a freezing chamber door 111 and a refrigerating chamber door 112 respectively mounted to be opened and closed forwardly of the freezing chamber 103 and the refrigerating chamber 109; a cooing air supply unit installed at a rear side of the refrigerating chamber 103 and supplying air cooled while passing a refrigerating cycle to the freezing chamber 103 and the refrigerating chamber 109; and a vegetable room provided at a lower side of the refrigerating chamber 109 and keeping fruits, vegetables or functional storage items.

The refrigerating cycle includes a compressor 104 for changing a low temperature and low pressure gaseous refrigerant to a high temperature and high pressure gaseous refrigerant; a condenser (not shown) for condensing the gaseous refrigerant which has been compressed in the compressor 104 to a liquid state and externally discharging heat; an expander (not shown) formed as a capillary tube for changing the refrigerant in the liquid state as changed in the condenser to a low temperature and low pressure saturated liquid state; and an evaporator 106 for evaporating the refrigerant in the saturated liquid state, as changed in the expander in the low temperature gas state to absorb external heat.

The cooling air supply unit includes a blow fan 115 mounted at a surface of a rear wall of the freezing chamber 103 and forcibly ventilating air cooled while passing the evaporator 106; a panel 114 disposed at a front side of the blow fan 115 and having a plurality of cooling air discharge holes 112 for supplying cooling air into the freezing chamber 103; a cooling air supply passage 117 formed penetrating the wall 105 to introduce the cooling air ventilated from the blow fan 115 to the refrigerating chamber 109; a cooling air discharge duct 118 mounted at a rear side of the refrigerating chamber 109 and communicating with the cooling air supply passage 117 to guide the cooling air supplied to the cooling-air supply passage 117 into the refrigerating chamber 109; and a cooling air inlet passage 116 formed penetrating the wall 105 to allow the cooling operation-completed air after having been circulated in the refrigerating chamber 109 to be re-introduced into the evaporator 106 and cooled.

The refrigerant discharge duct 118 includes a plurality of cooling air discharge holes 119 through which cooling air is discharged into the refrigerating chamber 109.

As shown in FIG. 2, the vegetable room is configured by the lowermost shelf of the plurality of shelves 107 and a vegetable box 108 disposed at the lower side of the lowermost shelf and opened upwardly with a receptacle space with a certain volume therein.

As the vegetable box 108 is slid forwardly and backwardly at the lower side of the shelf 107, a storage stuff is received/taken away, and a space (h) is maintained between the shelf 107 and the vegetable box 108.

The operation of the conventional refrigerator will now be described.

First, when the refrigerating cycle is driven and the blow fan 115 is rotated, air is cooled while passing the refrigerating cycle and discharged to the cooling air discharge hole 112 of the panel 114 and to the cooling air supply passage 117 by the blast pressure of the blow fan 115.

The cooling air being discharged into the cooling air discharge hole 112 circulates in the freezing chamber 103 to perform a cooling operation on the freezing food items stored in the freezing chamber 103.

The cooling air supplied to the cooling air supply passage 117 is introduced into the cooling air discharge duct 118 and then discharged into the refrigerating chamber 109 through the cooling air discharge hole 119 formed at the cooling air discharge duct 118.

The cooling air, which has been discharged into the refrigerating chamber 109, performs a cooling operation on the refrigerating food items received in the shelves 107 of the refrigerating chamber 109 and in the vegetable box 108 while circulating in the refrigerating chamber 109.

At this time, as the cooling air directly contacts with the refrigerating food items received on the shelves 107 and in the vegetable box 108, the cooling air takes the moisture from the refrigerating food items, containing more moisture, and as the cooling air is re-introduced into the refrigerating cycle through the cooling air inlet passage 116 formed at the wall 105, it is cooled again. The moisture moved along with the cooling air is congealed at the surface of the evaporator 106, is defrost in a frost-removing operation for the evaporator 106 and discharged outwardly.

Therefore, in a state that the refrigerating chamber door 113 is closed, the humidity inside the refrigerating chamber 109 is gradually lowered down due to the circulation of cooling air.

However, the conventional refrigerator has the following problems.

That is, first, since the vegetable box 108 is opened upwardly, cooling air supplied into the refrigerating chamber 109 is introduced into the space between the vegetable box 108 and the shelf 107 to directly contact with the food items in the vegetable box 108. Accordingly, for food items requiring a suitable moisture in the vegetable box 108, because their moisture would be taken away by the cooling air, freshness of the food items is degraded and storage duration is shortened.

In addition, since the vegetable box is opened upwardly, if the refrigerating chamber door is opened and closed, external air of the refrigerator can be possibly introduced into the vegetable box.

Therefore, if an environment outside the refrigerator is relatively humid, the outside moisture Would be introduced into the vegetable box whenever the refrigerating chamber door is opened and closed, damping the dried food items in the vegetable box which need to be maintained dried.

Meanwhile, if the environment outside the refrigerator is relatively dry, the outside dried air would be introduced into the vegetable box whenever the refrigerating door is opened and closed, drying the food items such as fruits or vegetables in the vegetable box which need to be maintained with moisture. Then, the storage duration of the food items is shortened and freshness of the food items is degraded.

DISCLOSURE OF THE INVENTION

Therefore, it is an object of the present invention to provide a vegetable room for a refrigerator that is capable of maintaining food items stored in a vegetable box fresh regardless of environmental conditions outside a refrigerator by providing a box cover to close a vegetable box to prevent external air introduced in opening and closing a refrigerator door and cooling air inside a refrigerator from being introduced into the vegetable box and forming a cooling air ventilating hole at the box cover which can be opened and closed to introduce cooling air into the vegetable box or cut off introduction of cooling air into the vegetable box according to environment outside the refrigerator.

Another object of the present invention is to provide a vegetable room for a refrigerator in which a cooling air discharge hole of a cooling air discharge duct provided at a rear side is positioned to face a vegetable box and a nozzle is provided at a front side of the cooling air discharge hole to increase a cooling air discharge speed, so that cooling air can be smoothly circulated around the vegetable box to quickly perform a cooling operation on food items stored in the vegetable box and cooling air can be smoothly introduced into the vegetable box to preserve food items stored in the vegetable box fresh for a long period when a cooling air ventilating hole remains open.

To achieve these and other advantages and in accordance with the purpose of the present invention, as embodied and broadly described herein, there is provided a vegetable room for a refrigerator including: a vegetable box disposed inside a refrigerator in which a cooling air supply unit is provided to circulate cooling air therein and a plurality of shelves are provided, and having a receptacle space for receiving food items therein opened upwardly; a box cover for covering an opening side of the vegetable box to close the receptacle space of the vegetable box and having a plurality of cooling air ventilating holes formed at one side thereof to introduce cooling air into the vegetable box; a cover support unit interposed between the box cover and the shelf to support the box cover at the shelf; a plurality of opening and closing members for opening and closing the cooling air ventilating holes of the box cover; and an operating unit for operating the opening and closing members simultaneously.

To achieve the above objects there is also provided a vegetable room for a refrigerator in which a cooling air discharge hole of a cooling air discharge duct mounted at a rear side of a refrigerator is provided between a box cover and a shelf so that cooling air can be directly introduced between the box cover and the shelf, and a nozzle is provided at a front side of the cooling air discharge hole and formed with a sectional area diminished as it goes from the rear side to the front side in order to increase the discharge speed of cooling air.

MODES FOR CARRYING OUT THE PREFERRED EMBODIMENTS

Figure 1:
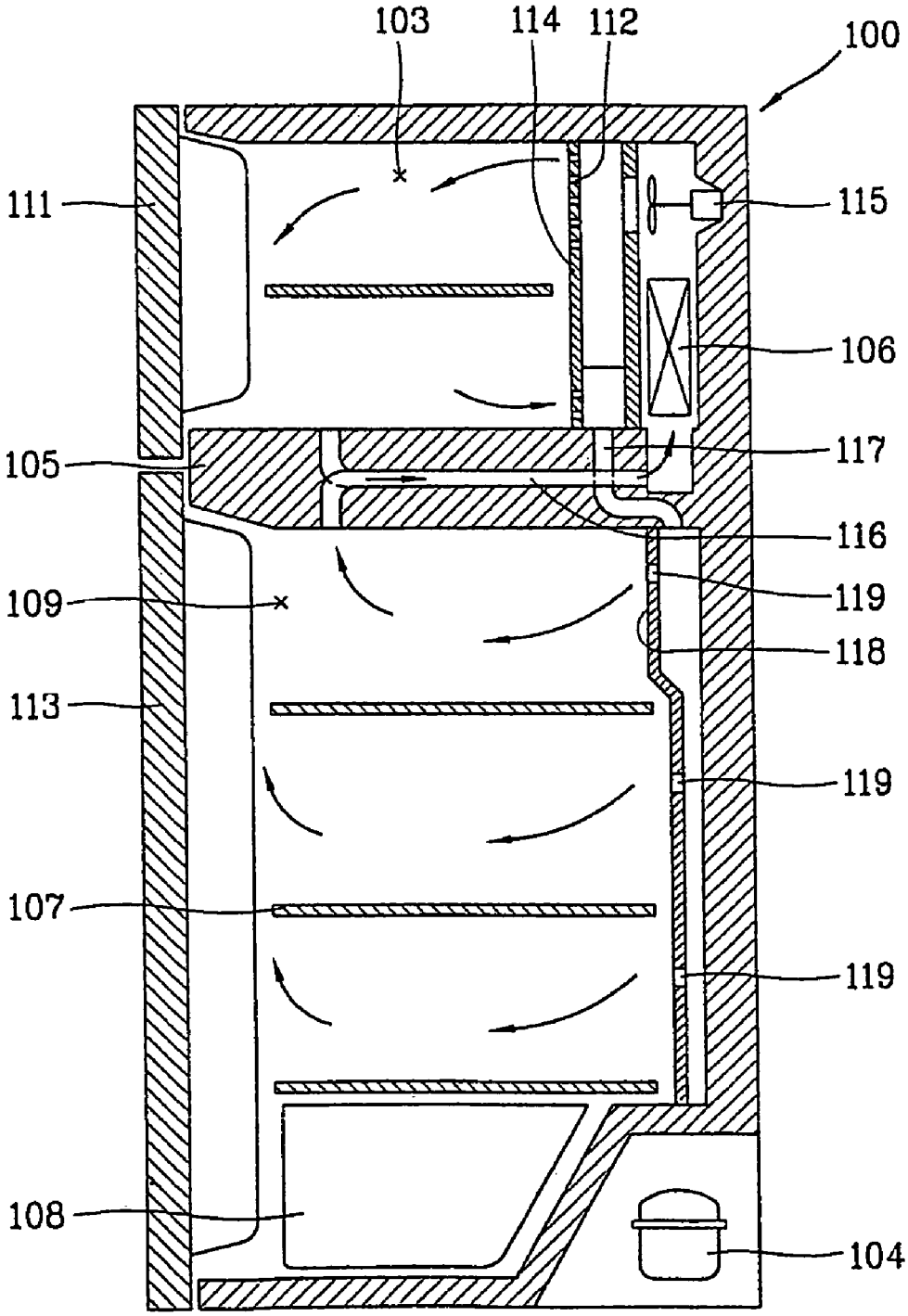
FIG. 1 is a vertical-sectional view showing a refrigerator in accordance with a conventional art.
Figure 2:
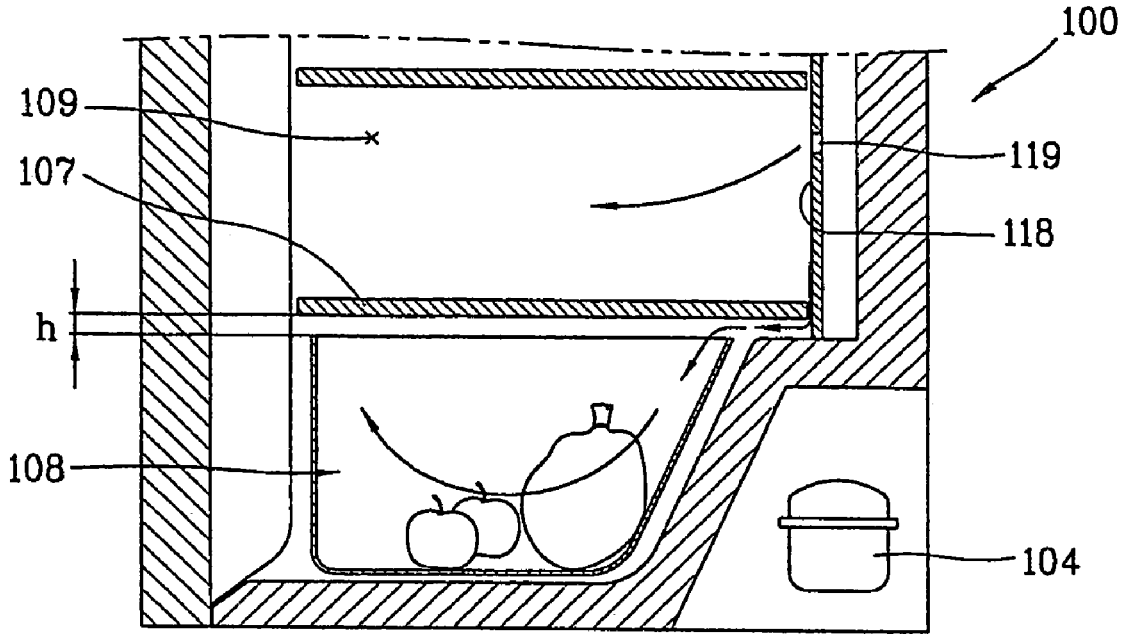
FIG. 2 is a vertical-sectional view showing a vegetable room for the refrigerator in accordance with the conventional art.
Figure 3:
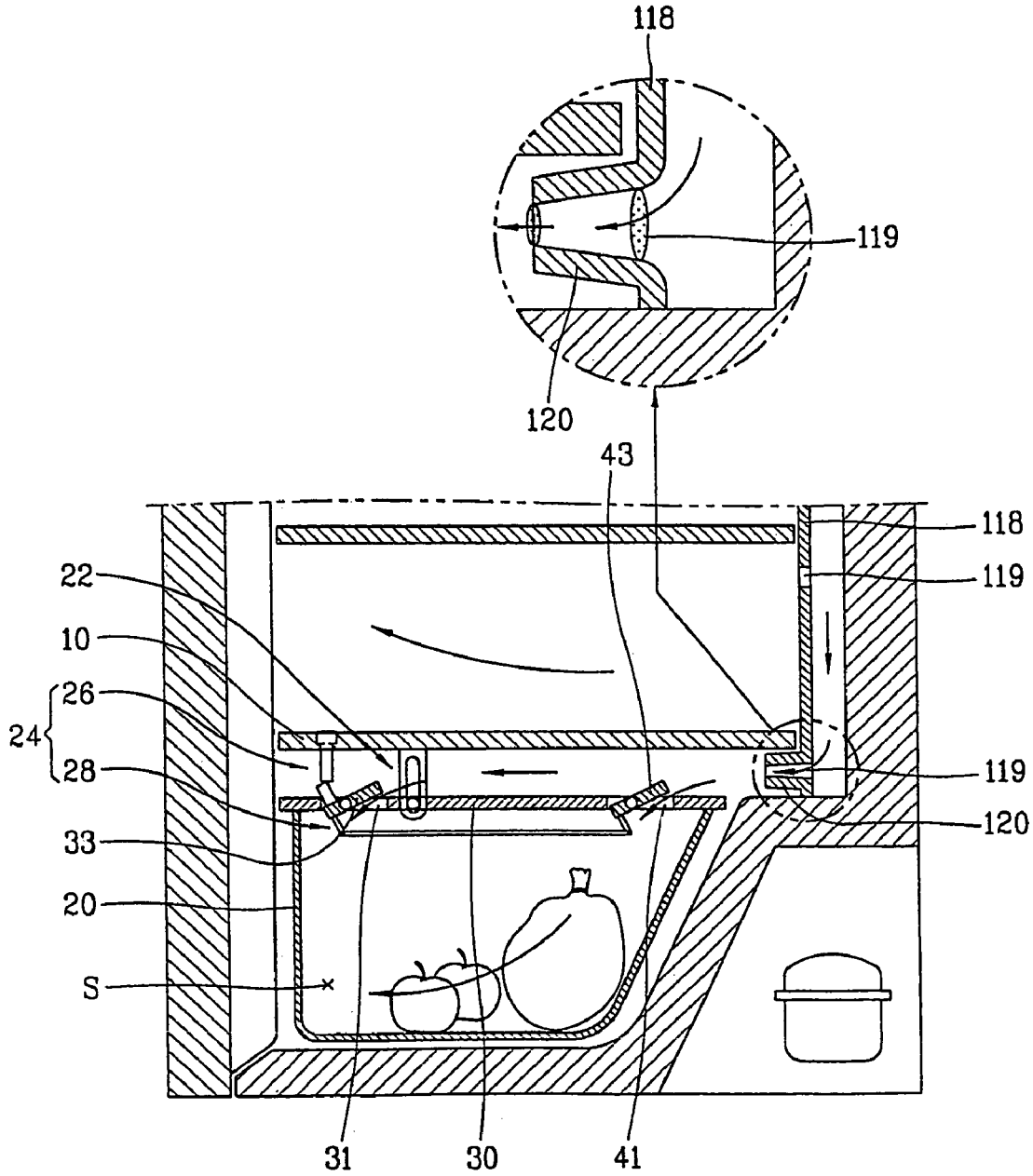
FIG. 3 is a vertical-sectional view showing a vegetable room for a refrigerator in accordance with the present invention.
Figure 4:
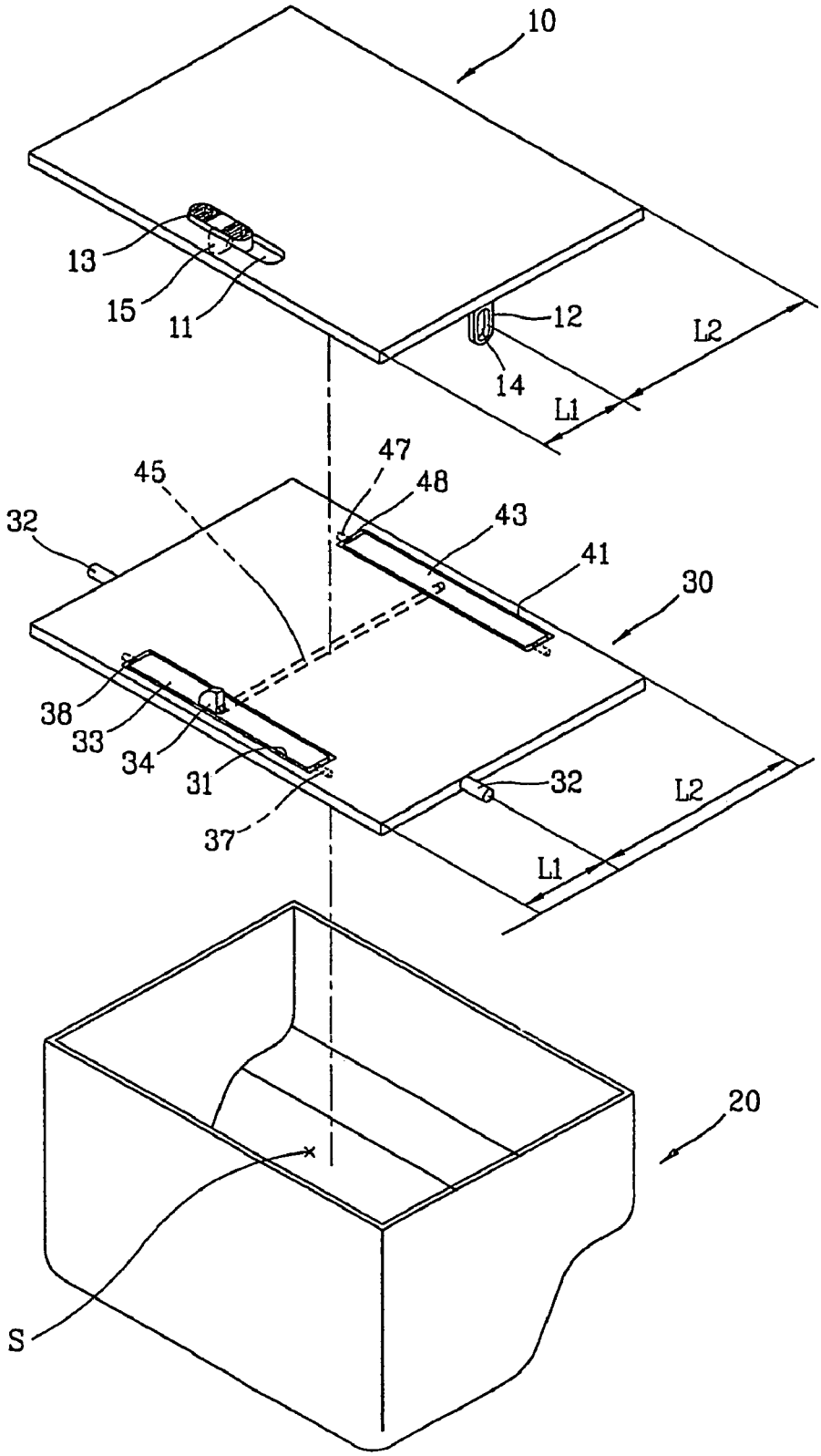
FIG. 4 is an exploded assembled view of a vegetable room for a refrigerator in accordance with the present invention.

FIG. 3 is a vertical-sectional view showing a vegetable room for a refrigerator in accordance with the present invention, and FIG. 4 is an exploded assembled view of a vegetable room for a refrigerator in accordance with the present invention.

As shown in FIGS. 3 and 4, a vegetable room for a refrigerator in accordance with the present invention includes: a vegetable box 20 disposed inside a refrigerating chamber and provided at a lower side of a shelf 10 for receiving food items thereon, and having a receptacle space (S) with a predetermined capacity upwardly opened to receive fruits, vegetables or functional storage stuffs therein; a box cover 30 for covering an opening side of the vegetable box 20 to close the receptacle space of the vegetable box 20 and having a plurality of cooling air ventilating holes 31 and 41 formed at one side thereof in order to allow cooling air to be introduced into the vegetable box 20; a cover support unit 22 interposed between the box cover 30 and the shelf 10 and supporting the box cover 30 at the lower side of the shelf 10; a plurality of opening and closing members 33 and 43 for opening and closing the cooling air ventilating holes of the box cover 30; and an operating unit 24 installed between the shelf 10 and the box cover 30 and operating the opening and closing members 33 and 43 simultaneously.

A cooling air discharge hole 119 of a cooling air discharge duct 118 is provided between the box cover 30 and the shelf 10 at a rear side of the refrigerator in order to discharge cooling air into the refrigerator, and a nozzle 120 is formed at a front side of the cooling air discharge hole 119 with a sectional area diminished as it goes from the rear side to the front side in order to increase a discharge speed of cooling air.

Accordingly, cooling air is smoothly circulated around the vegetable box 20 and quickly performs a cooling operation on food items preserved in the vegetable box 20, and when the cooling air ventilating holes 31 and 41 are opened, cooling air can be smoothly introduced into the vegetable box 20.

The nozzle 120 is preferably positioned at a rear side of the rearmost cooling air ventilating hole, so that when the cooling air ventilating holes 31 and 41 are opened, cooling air can be smoothly introduced into the vegetable box 20.

Figure 5:
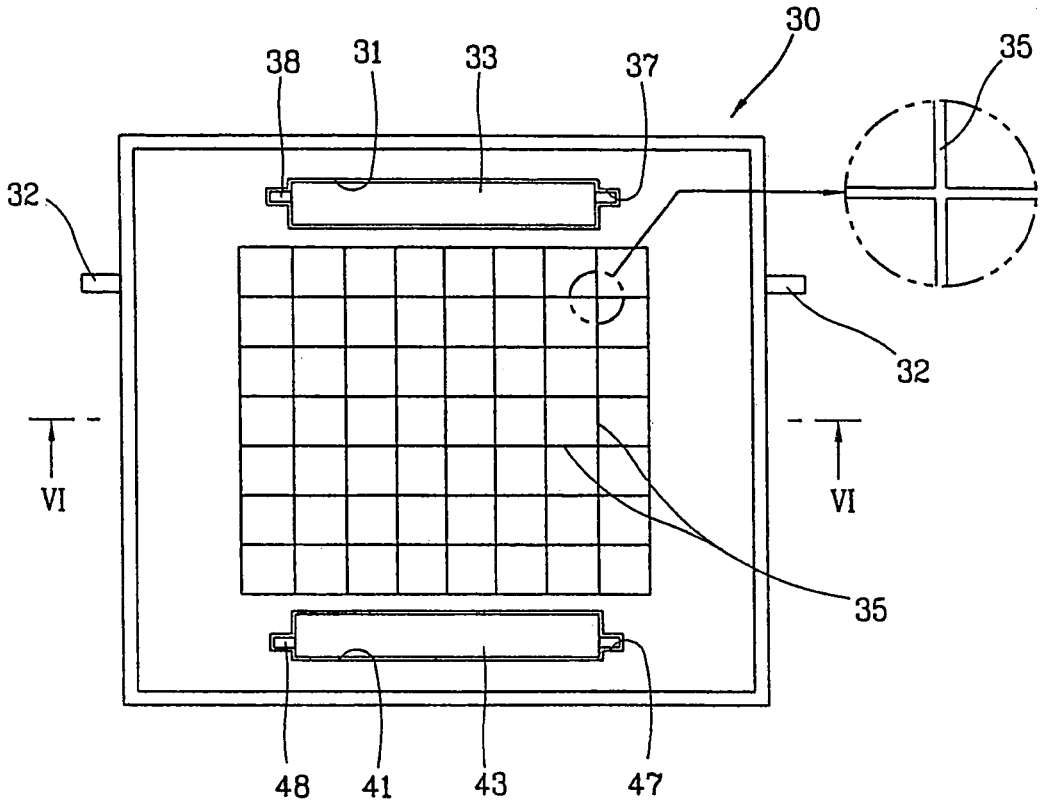
FIG. 5 is a plan view showing the bottom of a box cover of a vegetable room for a refrigerator in accordance with the present invention.
Figure 6:
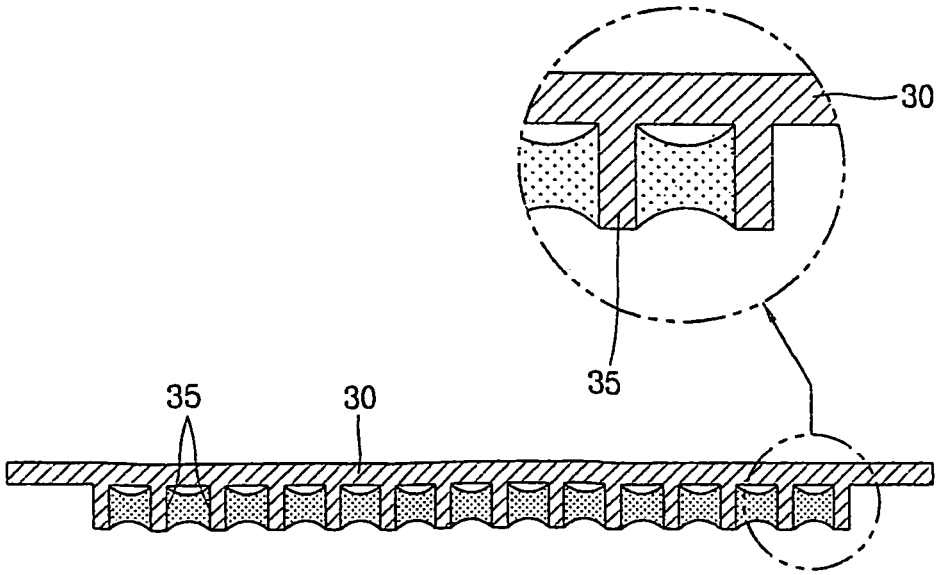
FIG. 6 is a sectional view taken along line VI-VI of FIG. 5.

As shown in FIGS. 5 and 6, the box cover 30 is formed in a square panel shape like the shelf 10 by using a transparent and light material.

Preferably, a plurality of ribs 35 are formed at a lower side of the box cover 30 to collect moisture existing in the vegetable box 20. The rib 35 has a grid form with a certain width and height so as to heighten a water-collection effect. As moisture existing inside the vegetable box 20 is collected at the grids of the rib 35, it is prevented from being discharged outwardly from the vegetable box 20.

The cooling air ventilating holes 31 and 41 of the box cover 30 are formed long and approximately perpendicular to the direction that cooling air is introduced, in order to allow cooling air to be smoothly introduced into the vegetable box 20.

There can be formed a plurality of cooling air ventilating holes within the area of the box cover 30. In the present invention, cooling air ventilating holes 31 and 41 are formed at a front side and at a rear side of the box cover 30. That is, a first cooling air ventilating hole 31 is formed at the front side of the box cover 30 and a second cooling air ventilating hole 41 is formed at the rear side of the box cover 30.

The cover support unit 22 consists of a hinge bracket 12 formed downwardly at both sides of the shelf 10 and having a hinge hole 14 formed long in a vertical direction, and a hinge shaft 32 formed extended at both sides of the box cover 30 and inserted to be movable in a vertical direction into the hinge hole 14 of the hinge bracket 12.

The cover support unit 22 is preferably formed eccentric toward the front side on the basis of the center of the box cover 30 so that when the vegetable box 20 is separated from the lower side of the shelf 10, the box cover 30 is somewhat lifted at its front side compared to the rear side owing to the self-weight.

The hinge bracket 12 and the hinge shaft 32 are positioned such that a distance (L1) from the front side of the shelf 10 and from the box cover 30 is shorter than a distance (L2) from the rear side of the shelf 10 and from the box cover 30.

Meanwhile, though not shown in the drawing, the hinge bracket 12 may be formed at the box cover 30, and accordingly, the hinge shaft 32 may be formed at the shelf 10.

The opening and closing members 33 and 43 are formed as a first opening and closing member 33 installed at the first cooling air ventilating hole 31 and a second opening and closing member 43 installed at the second cooling air ventilating hole 41, and formed platy with a predetermined thickness corresponding to the shape of the first and second cooling air ventilating holes 31 and 41.

Cylindrical support-shafts 38 and 48 are formed extended at both sides of the first and second opening and closing members 33 and 43. The support shafts 38 and 48 are inserted rotatably into insertion holes 37 and 47 formed at both sides of the first and second cooling air ventilating holes 31 and 41 in order to rotatably support the first and second opening and closing members 33 and 43 at the inner side of the first and second cooling air ventilating holes 31 and 41.

Figure 7:
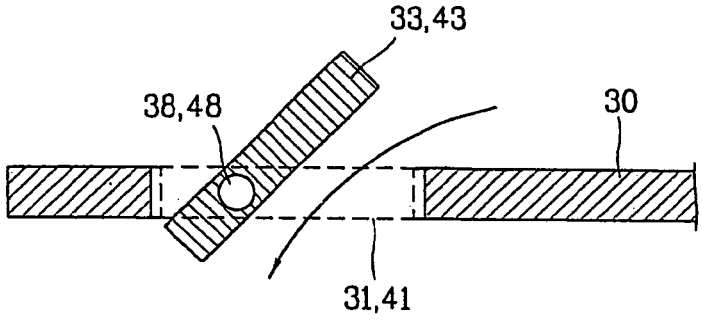
FIG. 7 is a sectional view showing how an opening and closing member is mounted at a box cover of the vegetable room for a refrigerator in accordance with the present invention.

As shown in FIG. 7, preferably, the support shafts 38 and 48 are formed eccentric toward the front side or toward the rear side on the basis of the center so that the first and second opening and closing members 33 and 43 are rotated by self-weight to close the first and second cooling air ventilating holes 31 and 41 after the first and second cooling air ventilating holes 31 and 41 are opened.

Either an outer circumferential surface of the support shafts 38 and 48 or an inner circumferential surface of the insertion holes 37 and 47 are formed to be polyhedral so that when a user opens and closes the first and second cooling air ventilating holes 31 and 41 by directly rotating the first and second opening and closing members 33 and 43 without using the operating unit 24, each of the opening and closing members 33 and 43 can maintain a rotation angle.

Figure 8:
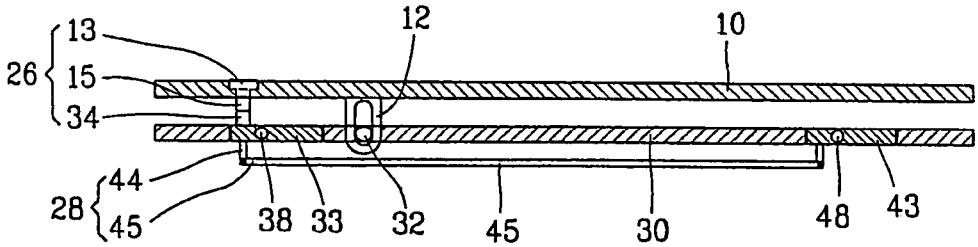
FIG. 8 is a partial sectional view showing the box cover of the vegetable room for a refrigerator in accordance with the present invention.
Figure 9:
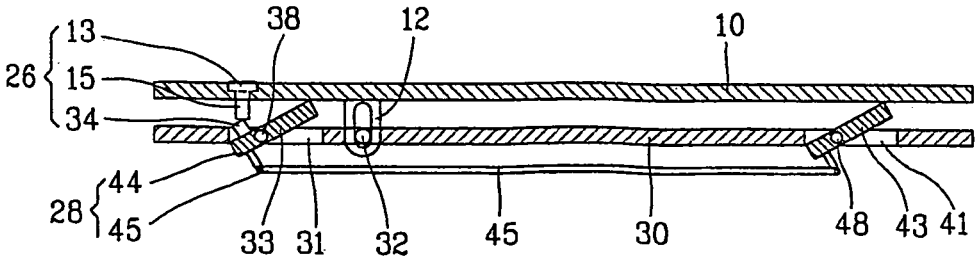
FIG. 9 is a partial sectional view showing how the opening and closing member is operated in the vegetable room for a refrigerator in accordance with the present invention.

As shown in FIGS. 8 and 9, the operating unit 24 consists of a driving unit 26 interposed between the box cover 30 and the shelf 10 and rotating the first opening and closing member 33 to open the first cooling air ventilating hole 31; and an coupling unit 28 for interacting with the driving unit 26 to simultaneously rotate the first and second opening and closing members 33 and 43 to open the second cooling air ventilating hole 41.

Figure 10:
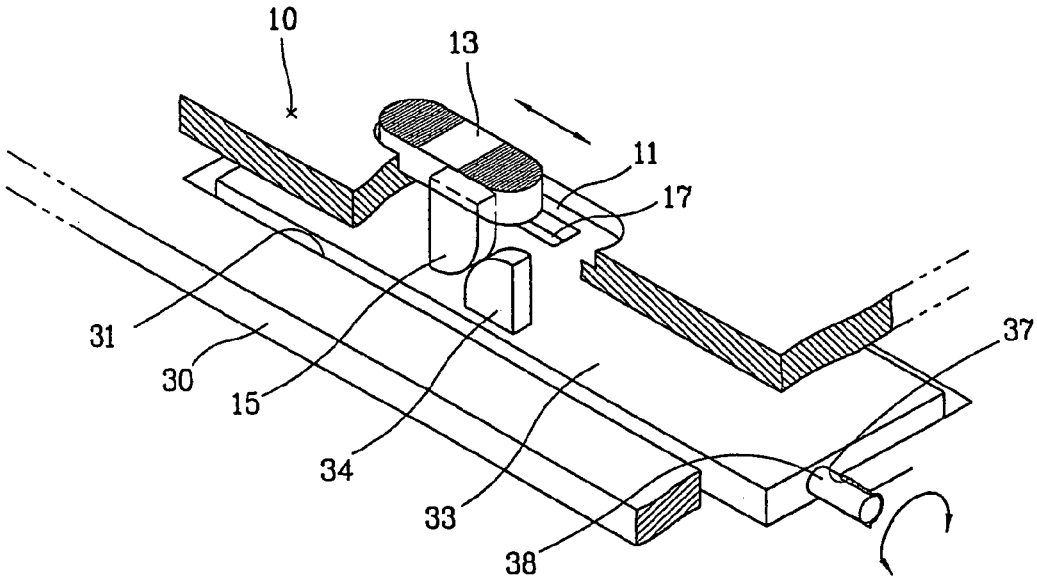
FIG. 10 is a partial perspective view showing a cooling air ventilating hole and the opening and closing member of the vegetable room for a refrigerator in accordance with the present invention.
Figure 11:
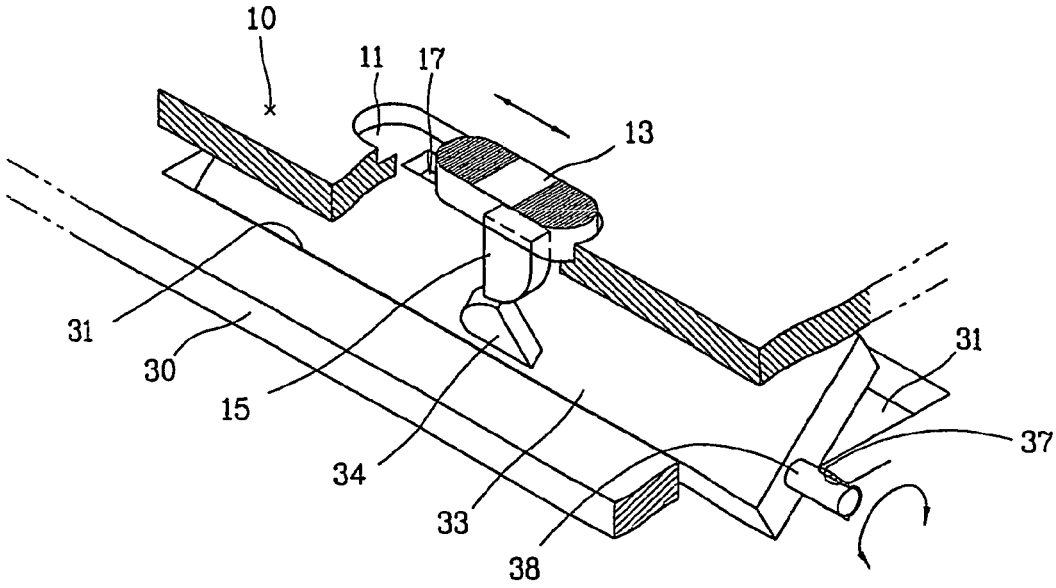
FIG. 11 is a partial perspective view showing how the opening and closing member is operated in the vegetable room for a refrigerator in accordance with the present invention.

As shown in FIGS. 10 and 11, the driving unit 26 consists of a first protrusion 34 formed protruded upwardly from the first opening and closing member 33; a knob 13 installed to be movable linearly at one side of the shelf 10; and a second protrusion 15 formed protruded downwardly from the knob 13 and rotating the first opening and closing member 33 by interaction with the first protrusion 34 when the knob 13 is moved.

A guide groove 11 is formed at the shelf 10 where the knob 13 is installed, to guide a linear movement of the knob 13, and a guide slot 17 is formed at the inner side of the guide groove 11 to allow the second protrusion 15 to pass through the shelf 10 and guides a linear movement of the second protrusion 15.

The first protrusion 34 converts the linear movement of the knob 13 into a rotational movement of the opening and closing member 33 by interacting with the second protrusion 15. The first protrusion 34 is formed inclined at a certain angle toward the second protrusion 15 so that it can rotate the opening and closing member 33 by being pushed by the second protrusion 15.

Preferably, the first protrusion 34 and the second protrusion 15 have a curved shape with a certain curvature at portions where they are mutually contacted with each other so that they can be smoothly slid.

As described above in the preferred embodiment of the present invention, the driving unit 26 is preferably installed at the front side near the refrigerator door, that is, at the side of the first opening and closing member 33, in consideration of users' convenience in operation, but, without being limited thereto, may be installed at the rear side of the refrigerator, that is, at the side of the second opening and closing member 43.

The coupling unit 28 consists of a connection pin 44 extended downwardly from the first and second opening and closing members 33 and 43, and a connection rod 45 hinge-connected at the lower side of the connection pin 44 and transmitting a rotational force of the first opening and closing member 33 to the second opening and closing member 43 when the first opening and closing member 33 is rotated by the driving unit 26.

The operation and effect of the vegetable room of the refrigerator in accordance with the present invention will now be described.

Food items containing moisture such as fruits or vegetables or storage stuffs desired to be maintained in a dry state are stored in the receptacle-space of the vegetable box 20. In order to maintain the freshness of such food items and storage stuffs at the maximum, each characteristic of storage stuffs should be preserved harmoniously through the following manipulation.

To begin with, the process of mounting the box cover 30 at the upper portion of the vegetable box 20 to close the receptacle space of the vegetable box 20 in order to prevent the food items inside the vegetable box 20 to directly contact with cooling air inside the refrigerator and with outdoor air of the refrigerator will now be described with reference to FIGS. 12A to 12C.

First, food items are put in the receptacle-space of the vegetable box 20 and the vegetable box 20 is inserted into the lower side of the shelf 10.

Figure 12A:
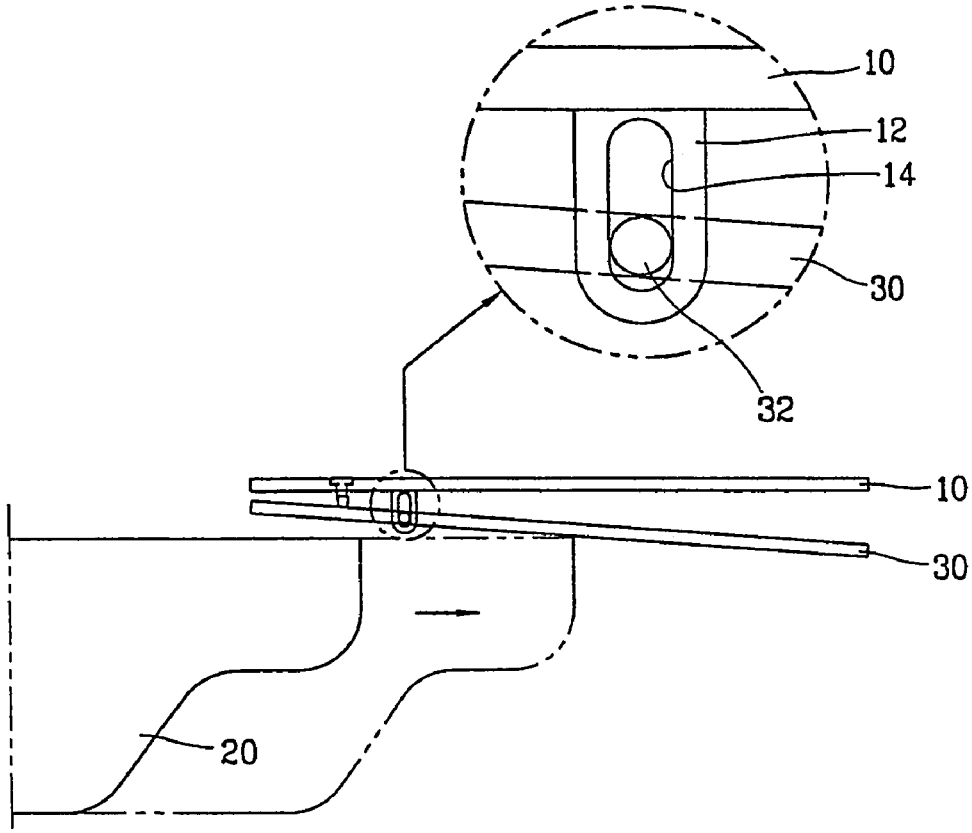
FIG. 12A to 12C are schematic views showing a process of mounting a box cover of a vegetable room on the vegetable box in accordance with the present invention.
Figure 12B:
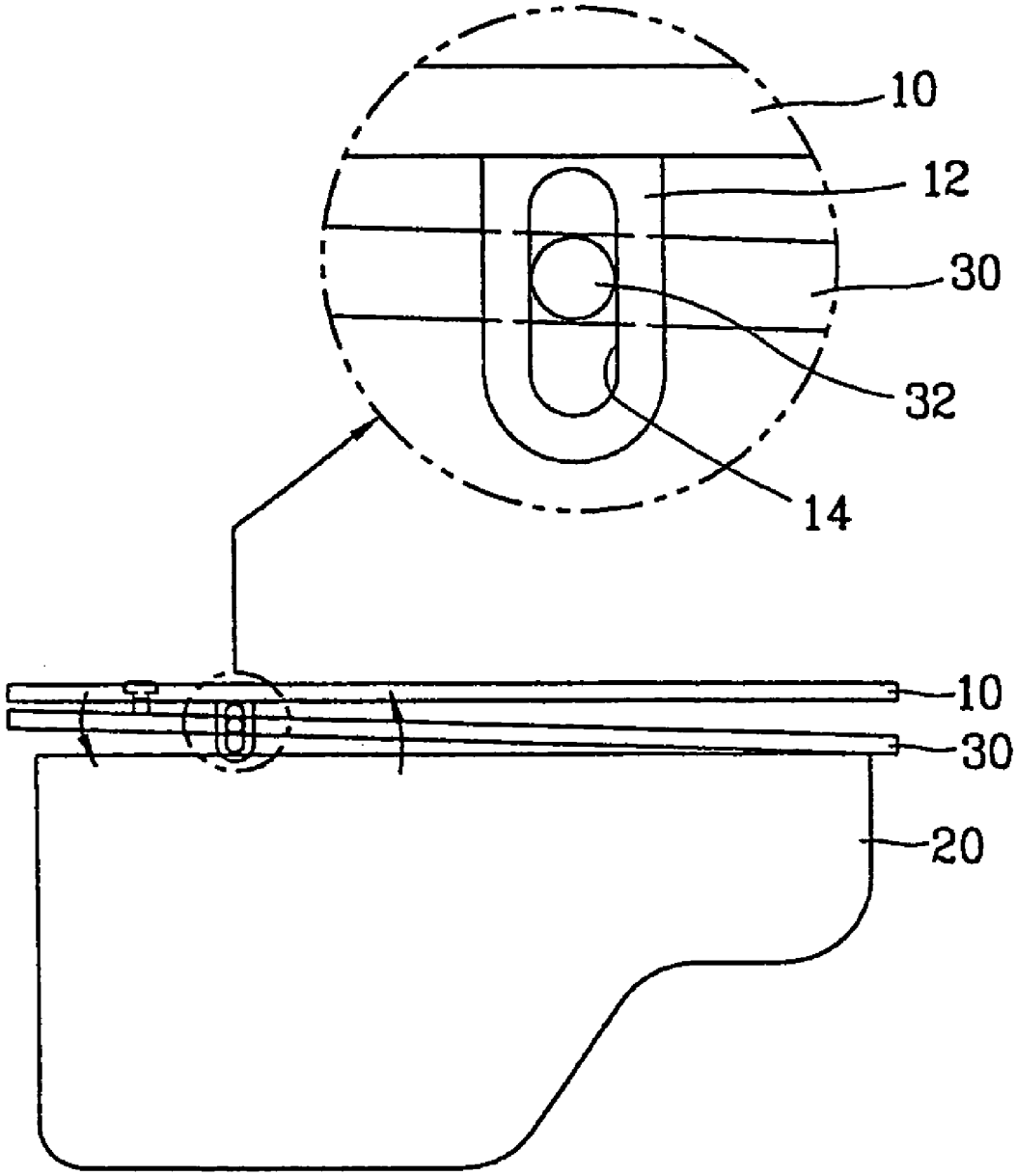

As shown in FIG. 12A, before the vegetable box 20 is inserted into the lower side of the shelf 10, the box cover 30 is inclined with its front side lifted. At this time, the vegetable box 20 is advanced until an upper end corner of the rear side of the vegetable box 20: is in contact with the rear side of the box cover 30. Then, as shown in FIG. 12B, the hinge shaft 32 provided at both sides of the box cover 30 is moved upwardly along the hinge hole 14 formed at the hinge bracket 12 provided at both sides of the shelf 10 and rotated-such that the front side of the box cover 30 descends and the rear side thereof is lifted.

Figure 12C:
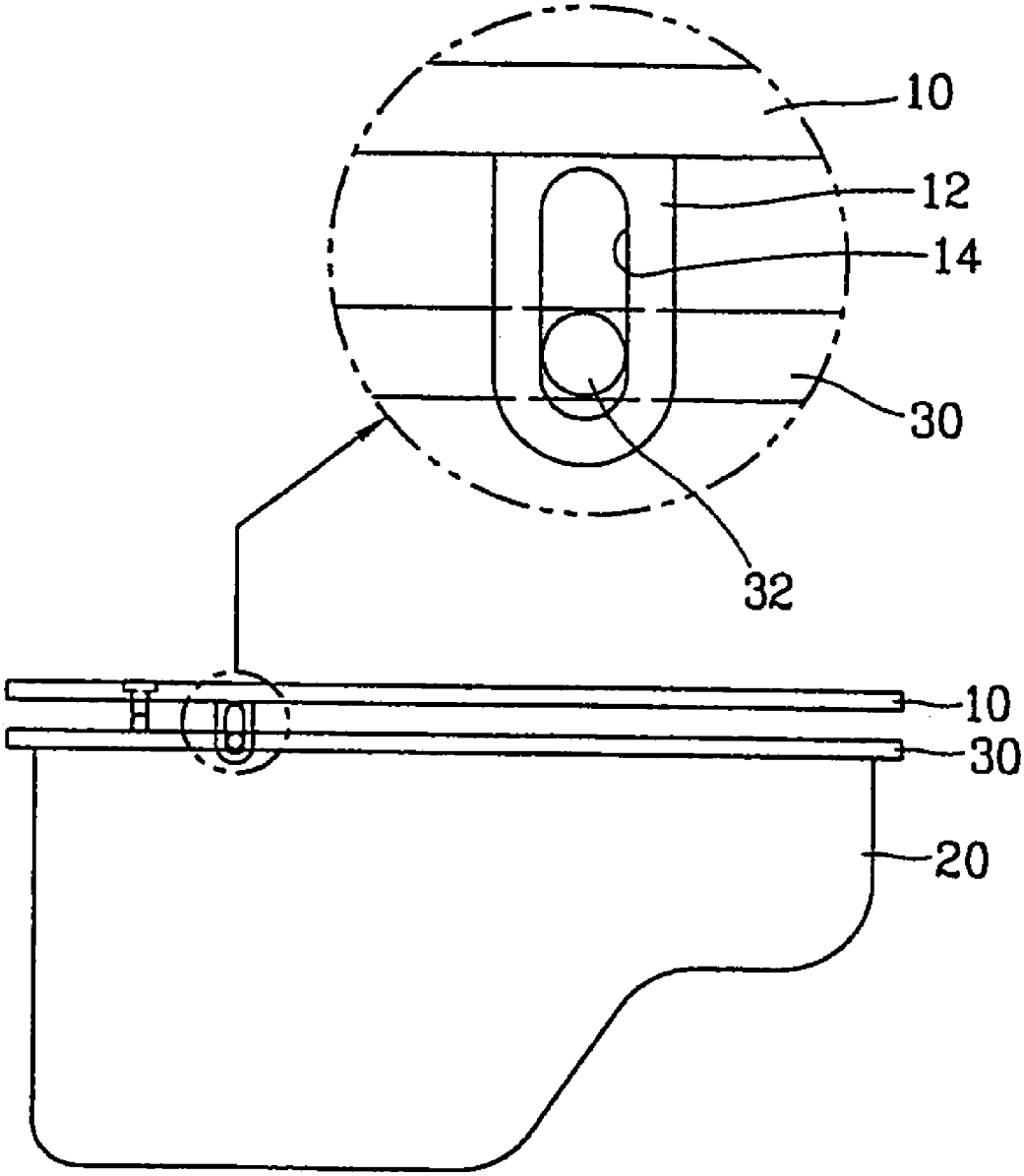

And then, as shown in FIG. 12C, after the vegetable box 20 is placed at a right position of the lower side of the shelf 10, the box cover 30 descends to be mounted at an upper side of the vegetable box 20.

Accordingly, the receptacle space of the vegetable box 20 is closed as the box cover 30 is mounted at the upper surface of the vegetable box 20, and thus, the food items stored in the receptacle space is prevented from directly contacting with cooling air circulating inside the refrigerator and at the same time outdoor air outside the refrigerator is prevented from being introduced thereinto and affecting the food items when the refrigerator door is opened and closed.

Meanwhile, if a condition outside the refrigerator is humid and the refrigerator door is opened and closed, when a food item is put into the vegetable box 20, the humid air is bound to be introduced into the vegetable box 20 together with the food item.

At this time, if a storage stuff preserved in the vegetable box 20 is in need of drying, since the vegetable box 20 is in a closed state by means of the box cover 30, the moisture introduced into the vegetable box 20 will not be discharged outwardly from the vegetable box 20 and cooled therein, making the storage stuff which needs drying to be damp.

In such a case, cooling air is let to be introduced into and circulated in the vegetable box 20 so as to take moisture away from the vegetable box 20 and discharge it outwardly, thereby maintaining the storage stuff in a dried state.

When cooling air is desired to be introduced into the vegetable box 20, the first and second cooling air ventilating holes 31 and 41 are opened, rather than detaching the box cover 30, processes of which will now be described.

First, when the knob 13 installed at the shelf 10 is slid in an opening direction (that is, in the right direction in FIG. 10 or 11), the second protrusion 15 of the knob 13 pushes the curved face of the first protrusion 34 of the opening and closing member 33. Then, being pushed, the first protrusion 34 moved downwardly, and the first opening and closing member 33 is rotated centering around the support shaft 38 extendedly formed at both sides thereof, thereby opening the first cooling air ventilating hole 31.

At the same time, the second opening and closing member 43 receives the rotational force of the first opening and closing member 43 through the connection 44 and the connection rod 45 the second opening and closing member 43 and is rotated to open the second cooling air ventilating hole 41.

As the first and second cooling air ventilating hole 31 and 41 are opened, cooling air circulated in the refrigerator is introduced into the vegetable box 20 and discharges moisture from the vegetable box 20, so that the vegetable box 20 can be maintained dry.

At this time, the cooling air discharge hole 119 is positioned between the box cover 30 and the shelf 10, cooling air can be smoothly introduced into the vegetable box 20, and the nozzle provided at the cooling air discharge hole 119 makes discharge speed; of cooling air fast, so that cooling air is fast introduced into and circulated in the vegetable box 20. Thus, dryness of storage stuffs inside the vegetable box 20 can be more effectively heightened.

Meanwhile, if a food item of which moisture needs to be maintained is preserved in the vegetable box, the first and second cooling air ventilating holes 31 and 32 must be closed to prevent the food item from being dehumidified by cooling air.

The first and second cooling air ventilating holes 31 and 32 are closed as follows.

That is, when the knob 13 installed at the shelf 10 is slid in a closing direction (that is, in the left direction in FIG. 10 or 11), the first opening and closing member 33 is rotated centering around the support shaft 38 due to its self weight, closing the first cooling air ventilating hole 31 of the box cover 30.

At the same time, like the first opening and closing member, the second opening and closing member 43 is rotated centering around the support shaft 48 by its self-weight, closing the second cooling air ventilating hole 41.

At this time, since the cooling air discharge hole 119 is positioned between the box cover 30 and the shelf 10 and the nozzle 120 accelerating the speed of cooling air is provided at the front side of the cooling air discharge hole 119, cooling air is smoothly circulated around the vegetable box 20 to perform a rapid cooling operation on food items kept in the vegetable box 20.

Accordingly, the receptacle space of the vegetable box 20 is closed and introduction of cooling air to moisture-containing food items which need to maintain the moisture as it is, such as vegetables and fruits, is cut off. In this manner dehydration is prevented.

At this time, moisture may be taken away from the food items in the receptacle space but since this moisture ascends and is coagulated at the rib 35 formed protruded at a lower side of the box cover 30, moisture leakage is prevented and thus the humidity of the food items can be effectively maintained.

As so far described, the vegetable room for a refrigerator in accordance with the present invention has many advantages.

That is, the box cover is provided to cover the opening side of the vegetable box and the cooing air ventilating hole is formed at the box cover and closed when vegetables or fruits are preserved. Accordingly, preserved in the hermetic state, those moisture-maintaining desired food items will not be in contact with cooling air, so that dehydration of them can be prevented.

Especially, when food items which needs drying are preserved under the condition of a humid environment outside the refrigerator, the cooling air ventilating hole is opened to let cooling air to be in contact with the dry-kept food items in the vegetable box and continuously move moisture generated from the food items by means of cooling air, thereby maintaining the food items in the dry state. In this manner, the storage condition of food items preserved in the vegetable box can be optimized.

The plurality of cooling air ventilating holes are formed at the box cover and high speed cooling air is directly supplied between the box cover and the shelf through the cooling air discharge hole of the cooling air discharge duct and the nozzle. Thus, cooling air can be smoothly introduced into the vegetable box.

In addition, the cooling air ventilating hole can be simply opened and closed without detaching the box cover in introducing cooling air into the vegetable box or cut off cooling air with the vegetable box.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

The invention claimed is:

1. A vegetable room for a refrigerator, comprising:

a vegetable box configured to be disposed inside a refrigerator in which a cooling air supply device that circulates cooling air therein and a plurality of shelves are provided, and having a receptacle space that receives food items therein opened upwardly;

a box cover that covers an opening side of the vegetable box to close the receptacle space of the vegetable box and having a plurality of cooling air ventilating holes formed therein to introduce cooling air into the vegetable box;

a cover support device interposed between the box cover and a shelf; to support the box cover with respect to the shelf;

a plurality of opening and closing members that opens and closes the plurality of cooling air ventilating holes of the box cover; and an operating device that operates the plurality of opening and closing members simultaneously, wherein the cover support device is formed eccentric toward a front side with respect to a center of the box cover so that when the vegetable box is separated from a lower side of the shelf, the front side of the box cover is relatively lifted compared to a rear side thereof due to a weight of the box cover.

2. The vegetable room of claim 1, wherein the cover support device comprises:

a hinge bracket that extends downwardly from both left and right sides of the shelf and having a hinge hole formed therein; and a hinge shaft that extends at both left and right sides of the box cover and which is inserted into the hinge hole so as to be movable vertically.

3. The vegetable room of claim 2, wherein the hinge hole is formed to extend vertically.

4. The vegetable room of claim 1, wherein the cover support device comprises:

a hinge bracket that extends upwardly from both left and right sides of the vegetable box and having a hinge hole formed therein that extends vertically; and a hinge shaft that extends from both left and right sides of the shelf and which is inserted into the hinge hole so as to be movable vertically.

5. The vegetable room of claim 1, wherein the plurality of cooling air ventilating holes is formed to extend perpendicular with respect to a direction in which cooling air is introduced, in order to allow cooling air to be smoothly introduced into the receptacle space of the vegetable box.

6. A vegetable room for a refrigerator, comprising:

a vegetable box configured to be disposed inside a refrigerator in which a cooling air supply device that circulates cooling air therein and a plurality of shelves are provided, and having a receptacle space that receives food items therein opened upwardly;

a box cover that covers an opening side of the vegetable box to close the receptacle space of the vegetable box and having a plurality of cooling air ventilating holes formed therein to introduce cooling air into the vegetable box;

a cover support device interposed between the box cover and a shelf to support the box cover with respect to the shelf;

a plurality of opening and closing members that opens and closes the plurality of cooling air ventilating holes of the box cover; and an operating device that operates the plurality of opening and closing members simultaneously, wherein the plurality of opening and closing members comprises:

a first opening and closing member rotatably supported at an inner side of a first cooling air ventilating hole of the plurality of cool air ventilating holes formed at one side of the vegetable box; and one or more second opening and closing members rotatably supported at an inner side of one or more second cooling air ventilating holes of the plurality of cool air ventilating holes separated by a certain space from the first cooling air ventilating hole.

7. The vegetable room of claim 6, wherein the first and second opening and closing members are formed with a certain thickness and each includes a cylindrical support shaft that extends at both sides thereof, the support shaft being rotatably inserted into a corresponding insertion hole formed at hot sides of the respective cooling air ventilating hole in order to rotatably support the opening and closing member at the inner side of the cooling air ventilating hole.

8. The vegetable room of claim 7, wherein either an outer circumferential surface of the support shaft or an inner circumferential surface of the insertion hole are formed to be polyhedral so that a rotation angle of the opening and closing member is controllable by steps.

9. The vegetable room of claim 7, wherein each support shaft is formed eccentric toward a front side or toward a rear side with respect to a center of the respective opening and closing member so that the opening and closing member can close the cooling air ventilating hole by rotation according to self weight.

10. The vegetable room of claim 6, wherein the operating device comprises:

a driving device interposed between the box cover and the shelf and opening the first cooling air ventilating hole by rotating the first opening and closing member; and an coupling device that simultaneously rotates the first and second opening and closing members to open the second cooling air ventilating hole by interacting with the driving device.

11. The vegetable room of claim 10, wherein the driving device is installed at a front side of the vegetable box.

12. The vegetable room of claim 10, wherein the driving device is installed at a rear side of the vegetable box.

13. The vegetable room of claim 10, wherein the driving device comprises:

a first protrusion that protrudes upwardly from the first opening and closing member;

a knob installed to be movable linearly at one side of the shelf; and a second protrusion that protrudes downwardly from the knob and that rotates the first opening and closing member by interaction with the fast protrusion when the knob is moved.

14. The vegetable room of claim 13, wherein a guide groove is formed in the shelf configured to guide a linear movement of the knob.

15. The vegetable room of claim 14, wherein a guide slot is formed in an inner side of the guide groove to allow the second protrusion to pass through the shelf and guide a linear movement of the second protrusion.

16. The vegetable room of claim 13, wherein the fast protrusion is inclined at a certain angle in order to rotate the opening and closing member by being pushed by the second protrusion.

17. The vegetable room of claim 16, wherein the first protrusion and the second protrusion, respectively, have a curved shape with a certain curvature at portions where they contact each other so that they slide smoothly.

18. The vegetable room of claim 10, wherein the coupling device comprises:

a connection pin that extends downwardly from the first and second opening and closing members; and a connection rod hinge-connected at a lower side of the connection pin and transmitting a rotational force of the first opening and closing member to the second opening and closing member when the first opening and closing member is rotated by the driving device.

19. The vegetable room of claim 6, wherein a plurality of fibs is formed on a bottom of the box cover having a certain height and width to collect moisture inside the vegetable box.

20. The vegetable room of claim 19, wherein the plurality of ribs form a grid pattern.

21. The vegetable room of claim 6, further comprising a cooling air discharge hole of a cooling air discharge duct that discharges cooling air into a refrigerating chamber positioned between the box cover and the shelf at a rear side of the vegetable box so that cooling air is directly supplied between the box cover and the shelf.

22. The vegetable room of claim 21, wherein a nozzle is provided at a front side of the cooling air discharge hole, of which a sectional area decreases as it extends from a rear side to a front side of the nozzle in order to increase a discharge speed of cooling air.

23. The vegetable room of claim 22, wherein the nozzle is positioned at a rear side of a rearmost cooling air ventilating hole.

* * * * *